US006695193B1

(12) United States Patent
Chang

(10) Patent No.: US 6,695,193 B1
(45) Date of Patent: Feb. 24, 2004

(54) TRIGGER ASSEMBLY FOR STAPLE GUNS

(76) Inventor: Wen-Chou Chang, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 10/464,000

(22) Filed: Jun. 17, 2003

(30) Foreign Application Priority Data

Dec. 26, 2002 (TW) ..... 91221503 U

(51) Int. Cl.[7] ..... B25C 1/04
(52) U.S. Cl. ..... 227/8; 227/130
(58) Field of Search ..... 227/2, 8, 130, 227/9, 10; 123/46 SC

(56) References Cited

U.S. PATENT DOCUMENTS 5,687,899 A * 11/1997 Dohi et al. ..... 227/10
6,059,166 A * 5/2000 Ho et al. ..... 227/130
6,223,966 B1 * 5/2001 Nayrac et al. ..... 227/130
6,382,492 B1 * 5/2002 Moorman et al. ..... 227/8
6,431,429 B1 * 8/2002 Canlas et al. ..... 227/8
6,533,156 B1 * 3/2003 Chang ..... 227/130
6,604,664 B2 * 8/2003 Robinson ..... 227/130

* cited by examiner

*Primary Examiner*—Scott A. Smith
(74) *Attorney, Agent, or Firm*—Charles E. Baxley

(57) ABSTRACT

A staple gun includes an electro-magnetic valve received in a recess in the handle and an opening communicates with the main passage in the handle and the recess. The electro-magnetic valve has a shaft which movably seals the opening when the electro-magnetic valve is activated by pressing a button which is electrically connected to the electro-magnetic valve.

10 Claims, 17 Drawing Sheets

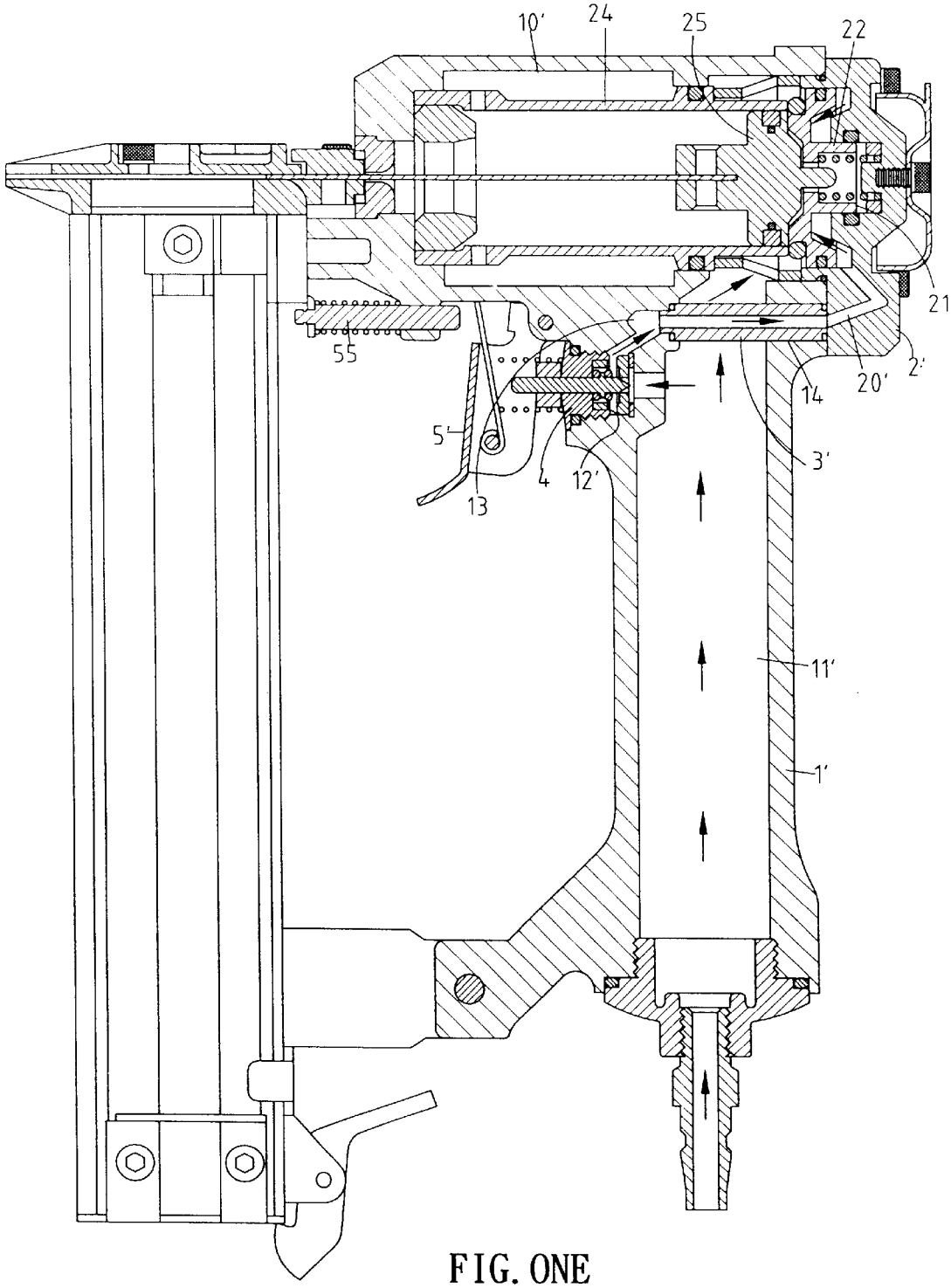
FIG. ONE
PRIOR ART

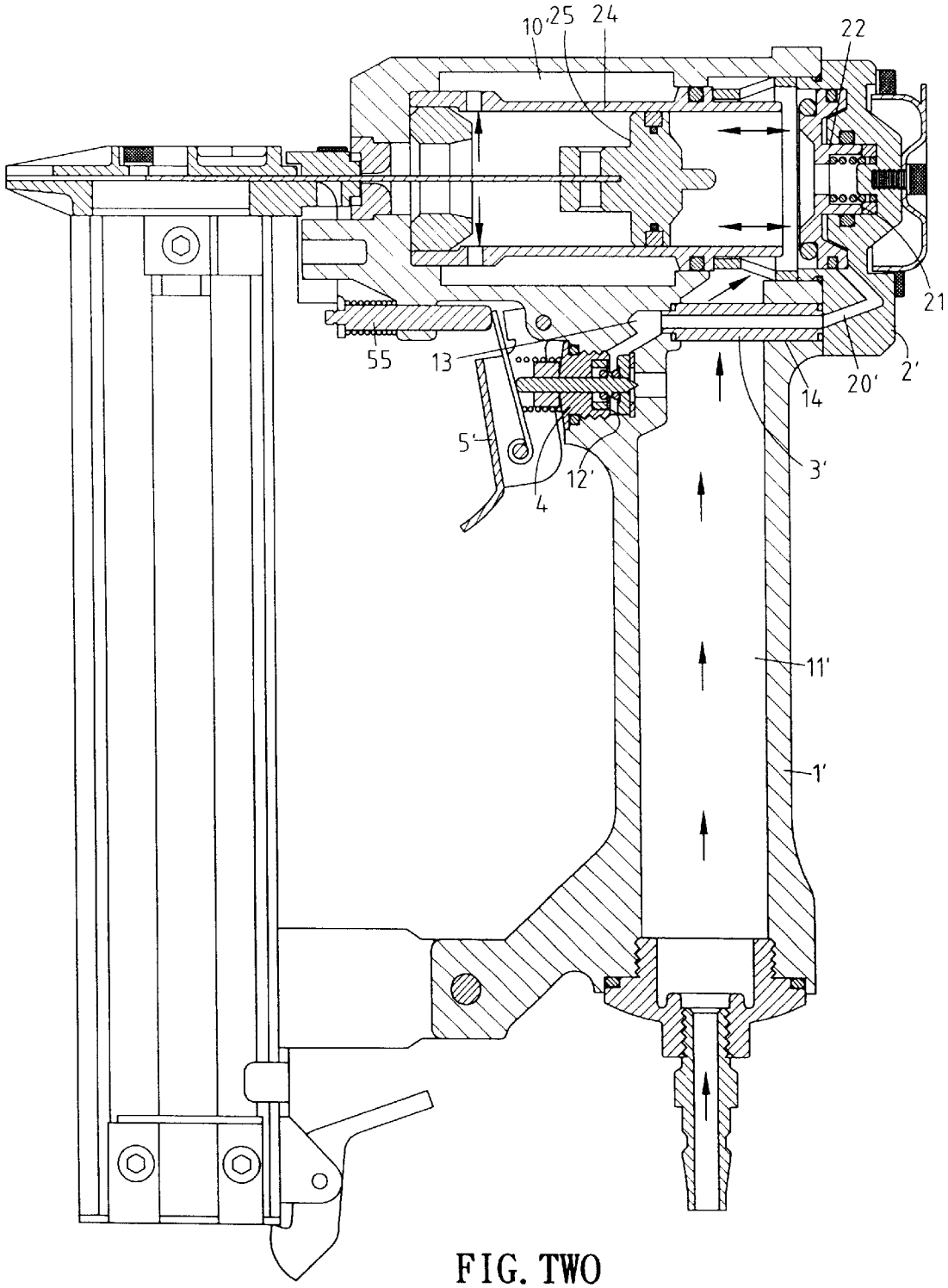
FIG. TWO
PRIOR ART

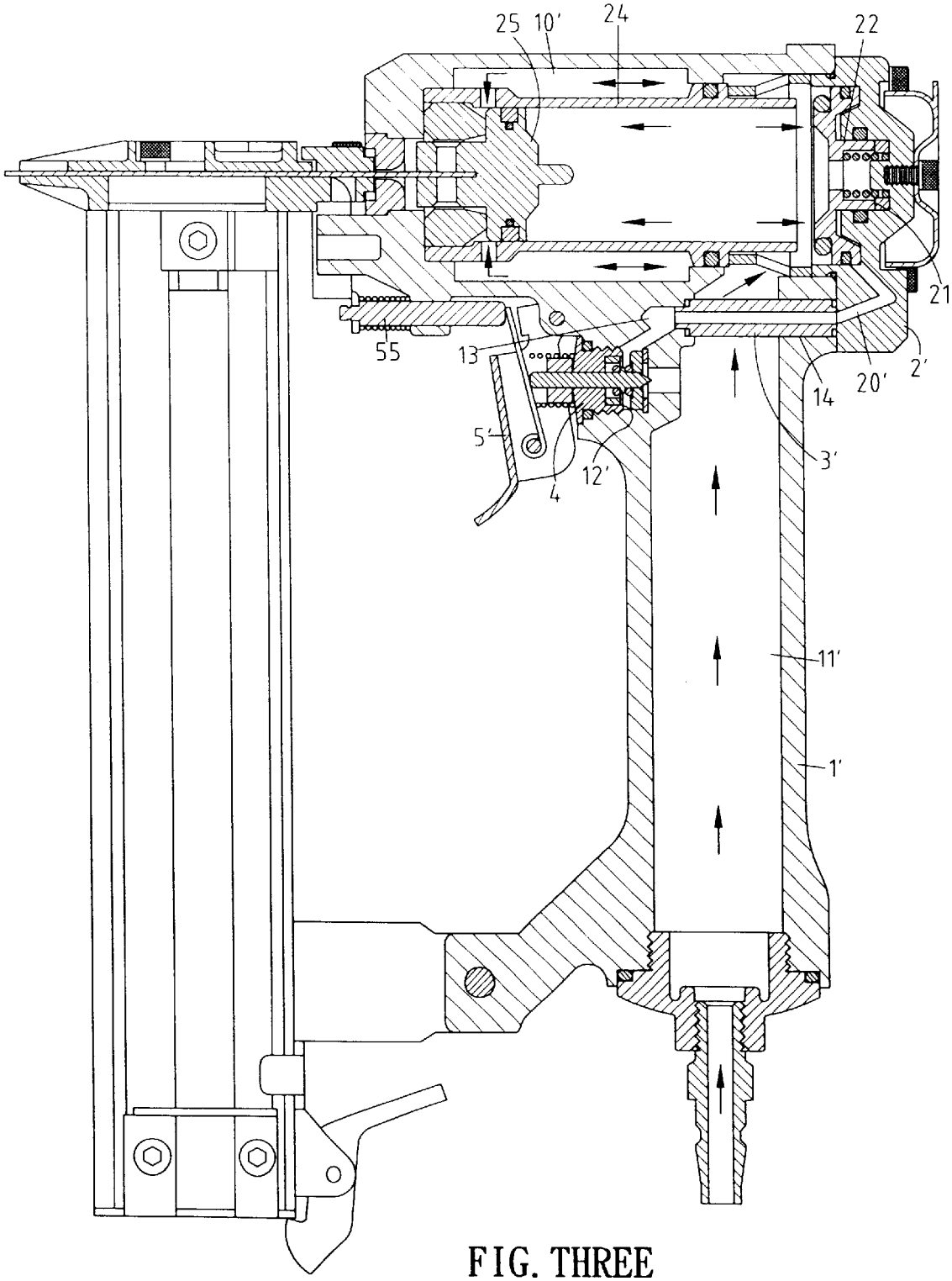
FIG. THREE
PRIOR ART

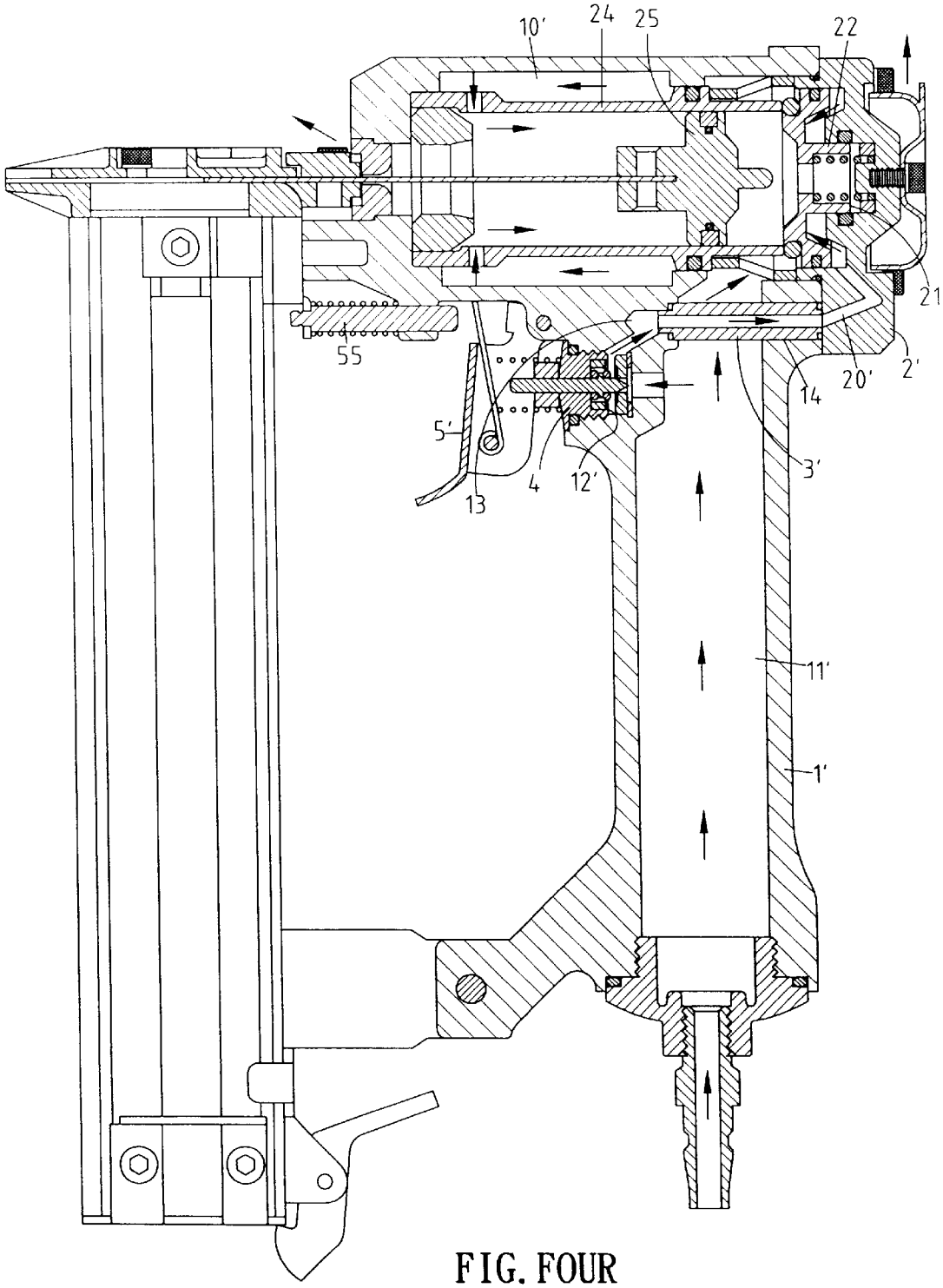
FIG. FOUR
PRIOR ART

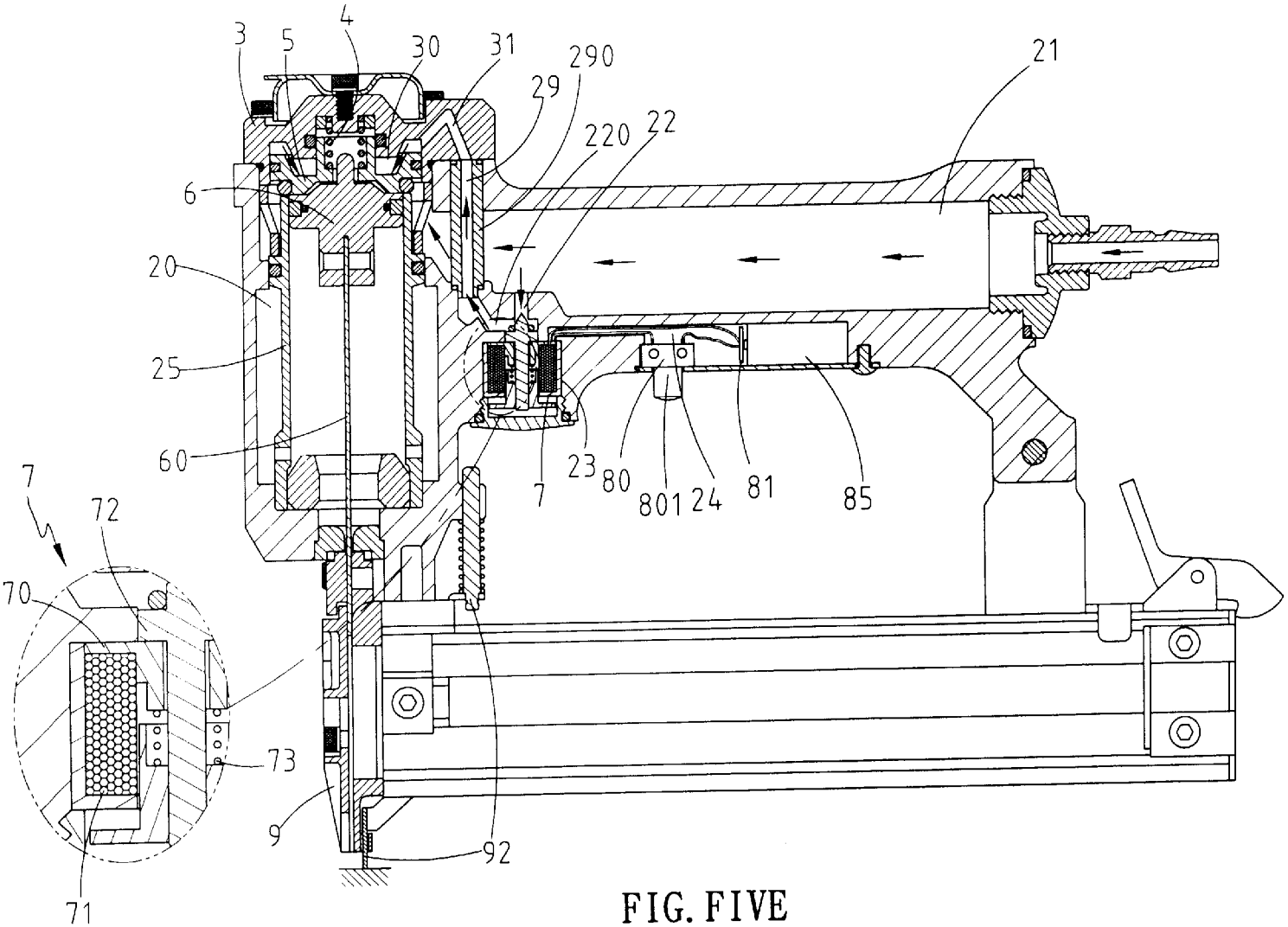
FIG. FIVE

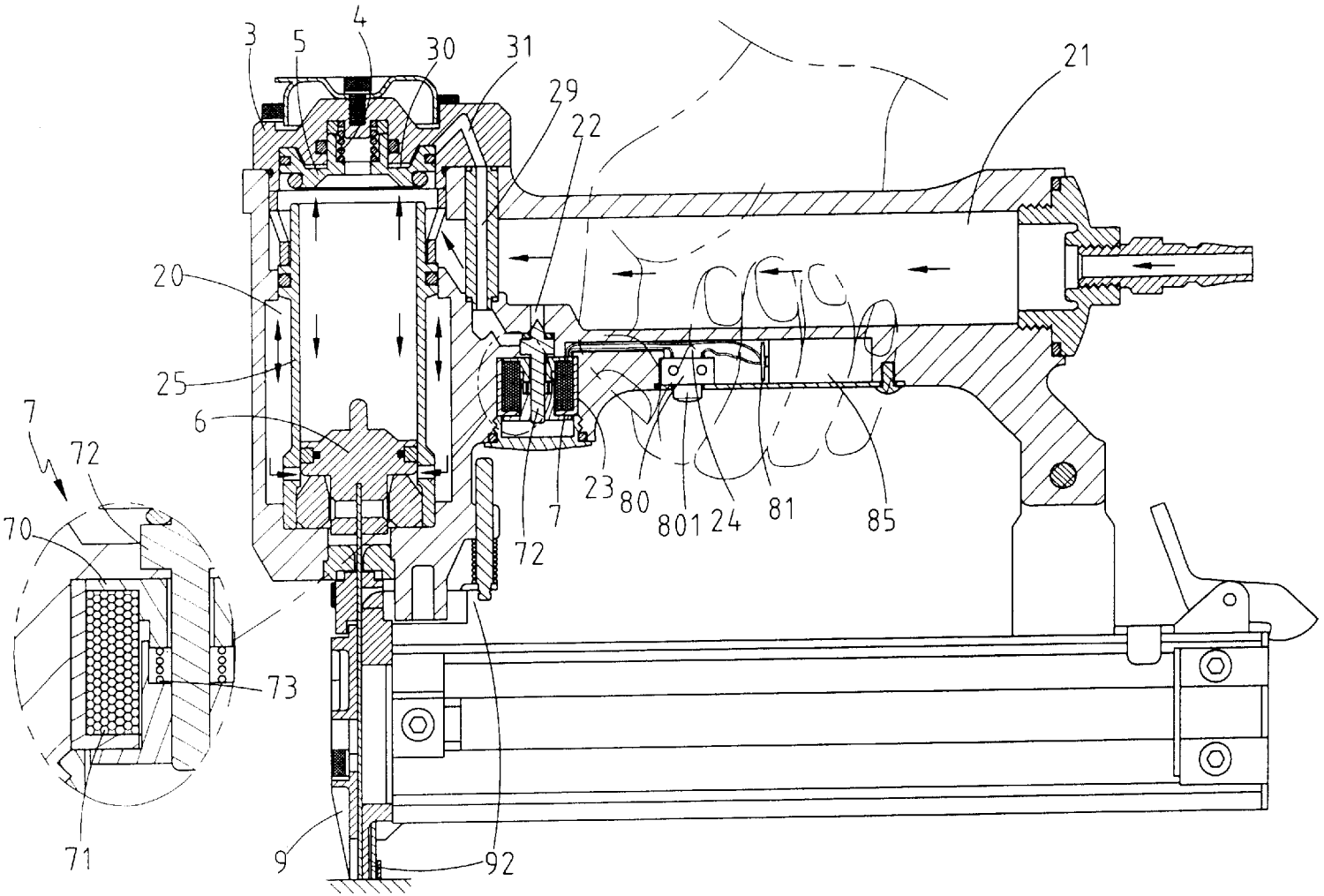
FIG. SIX

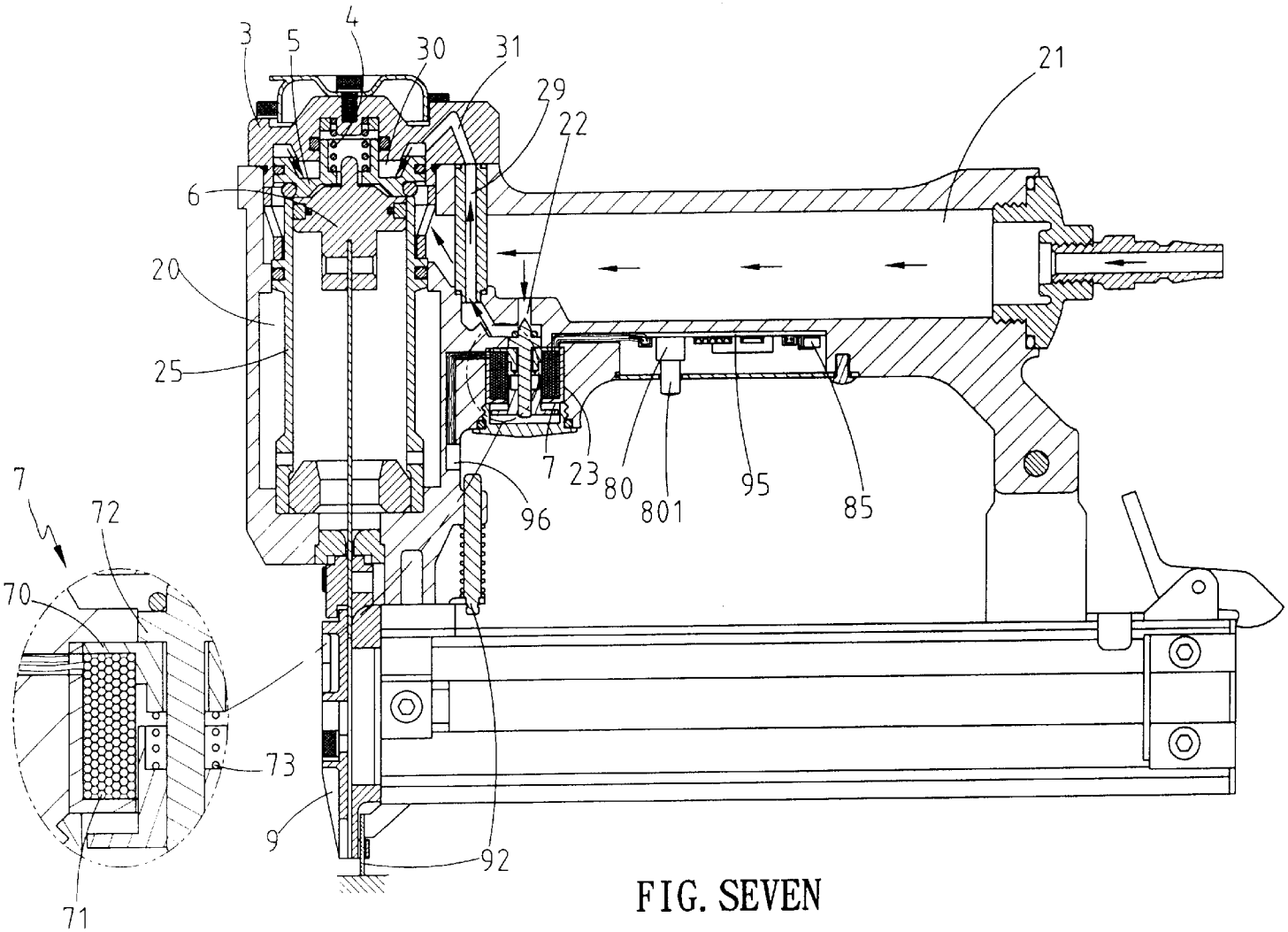
FIG. SEVEN

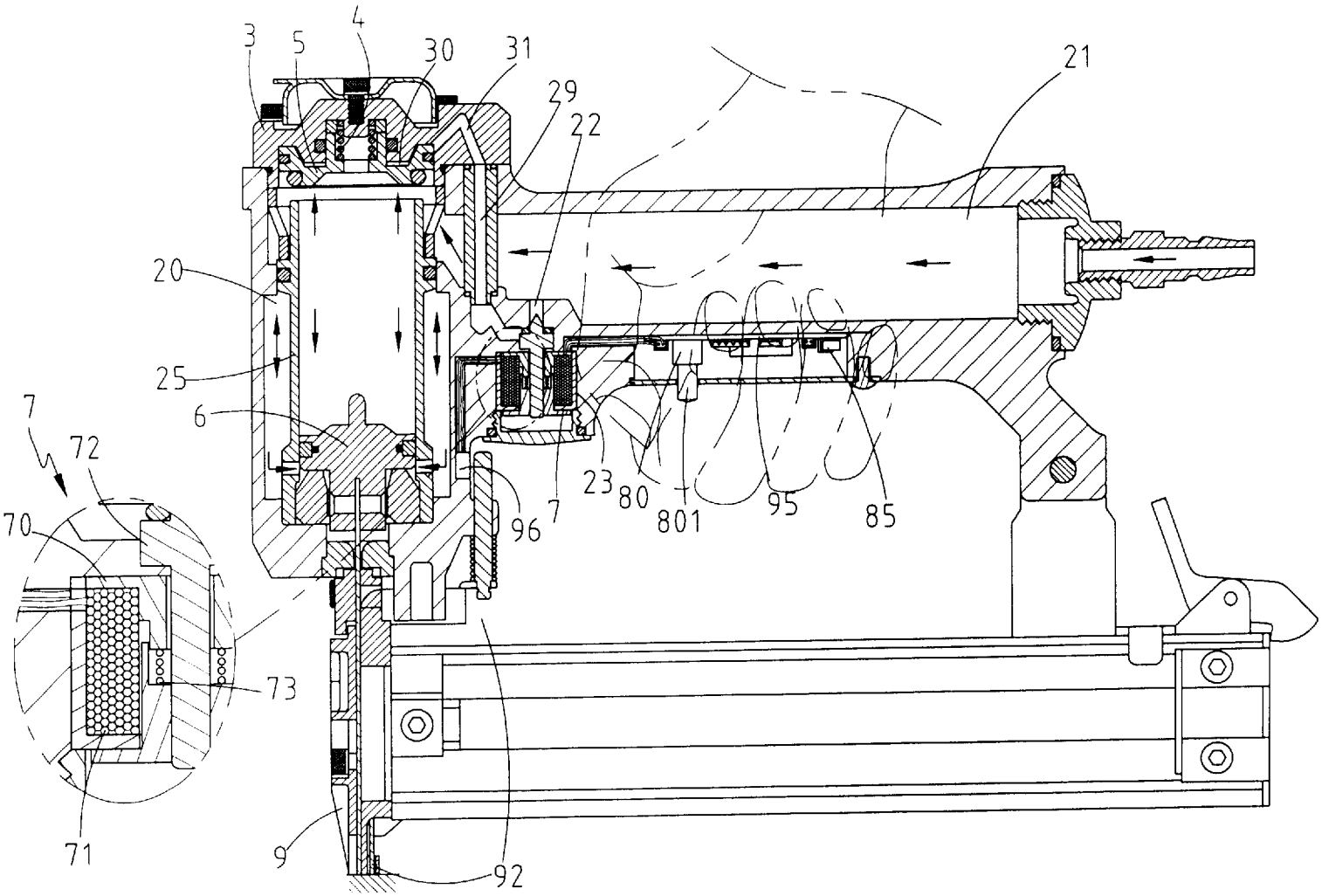
FIG. EIGHT

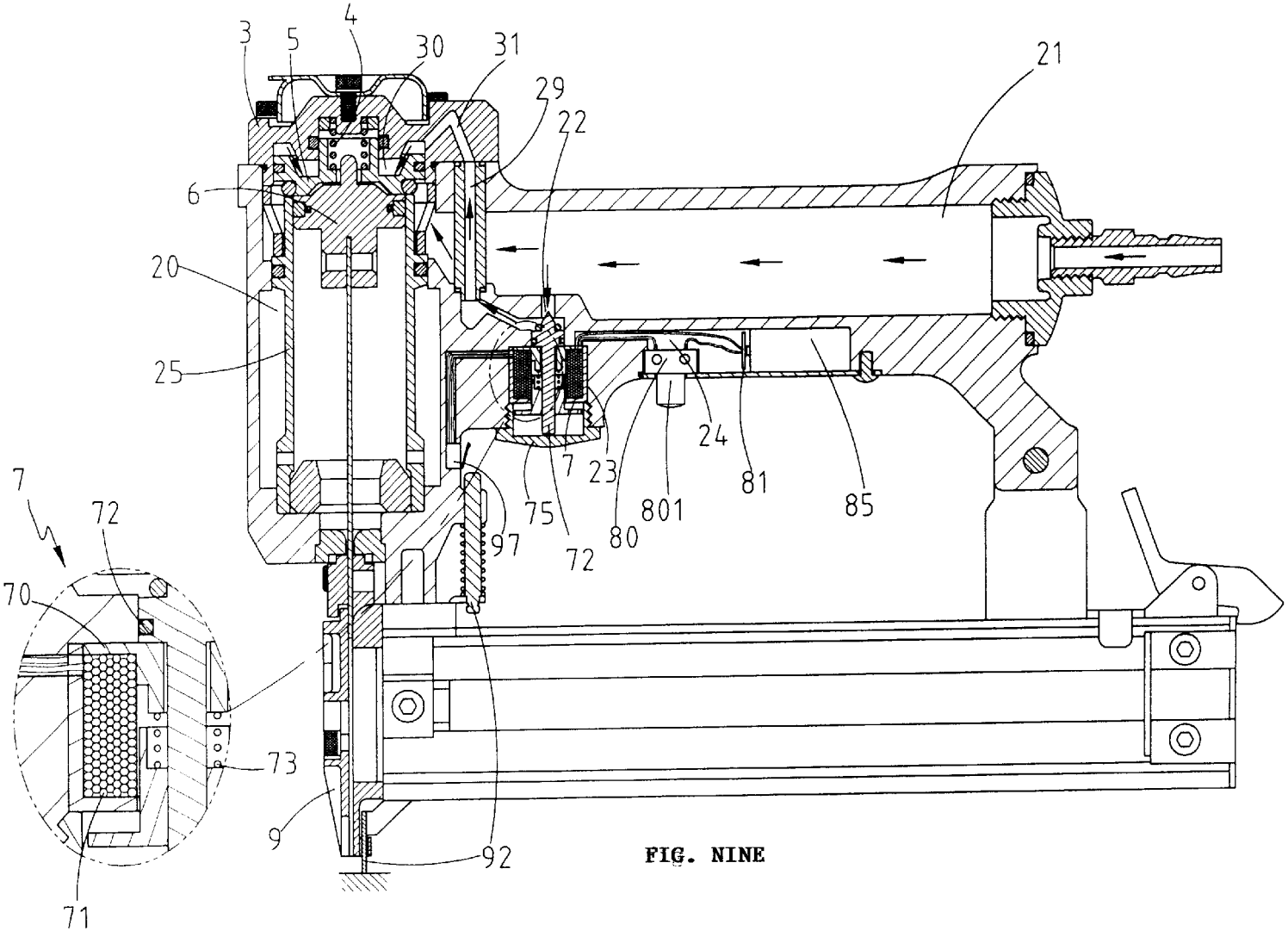
FIG. NINE

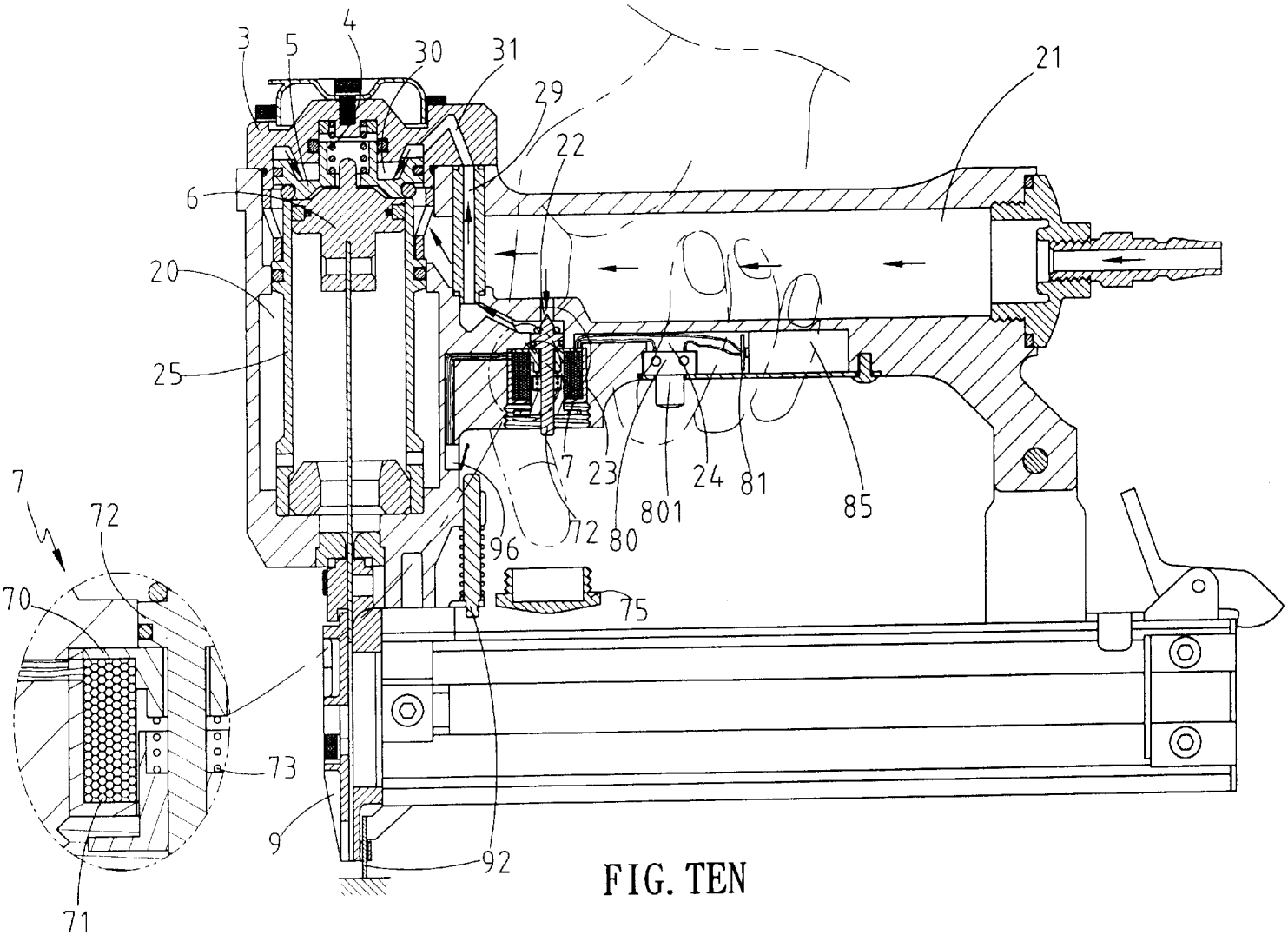
FIG. TEN

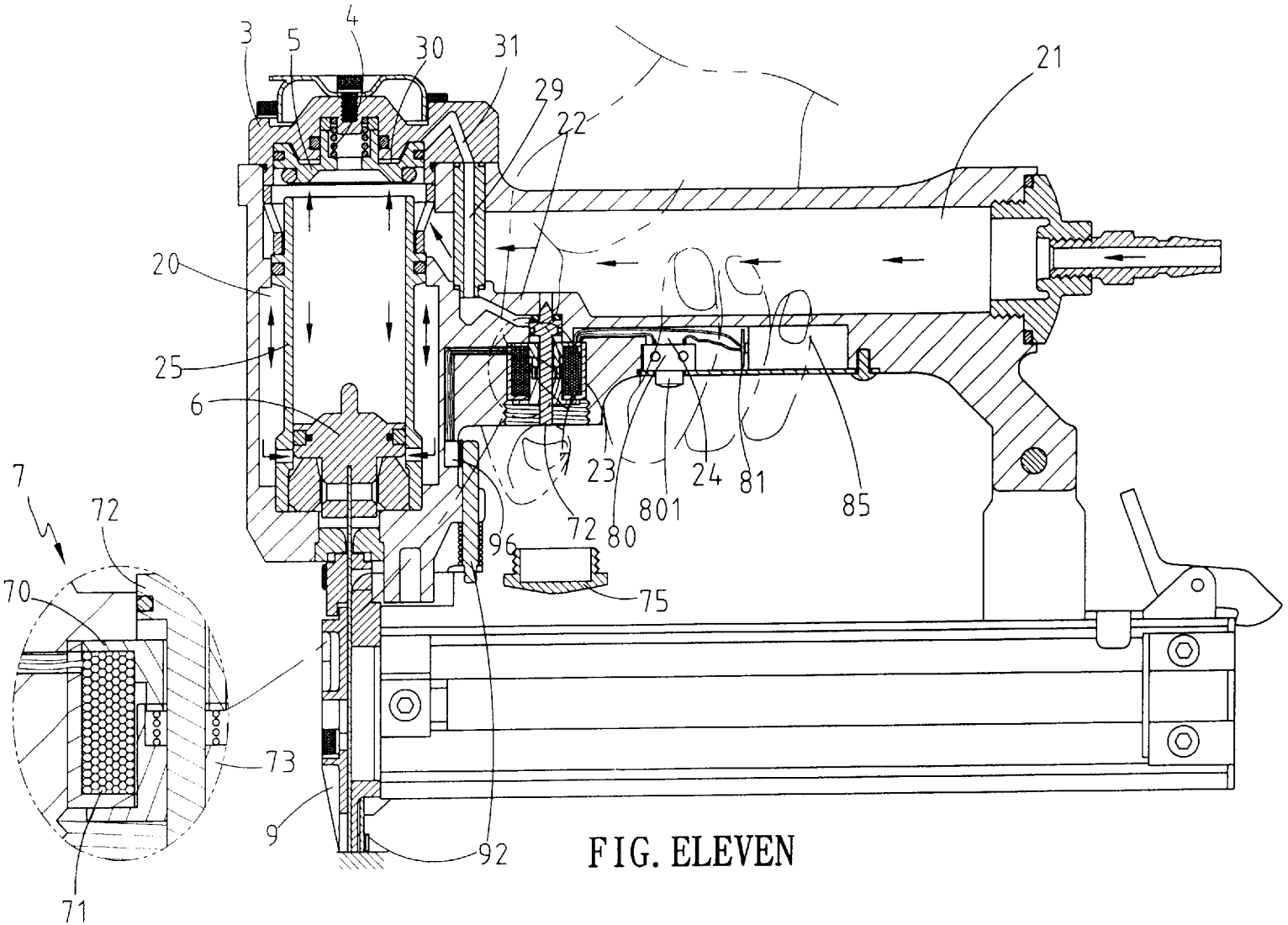
FIG. ELEVEN

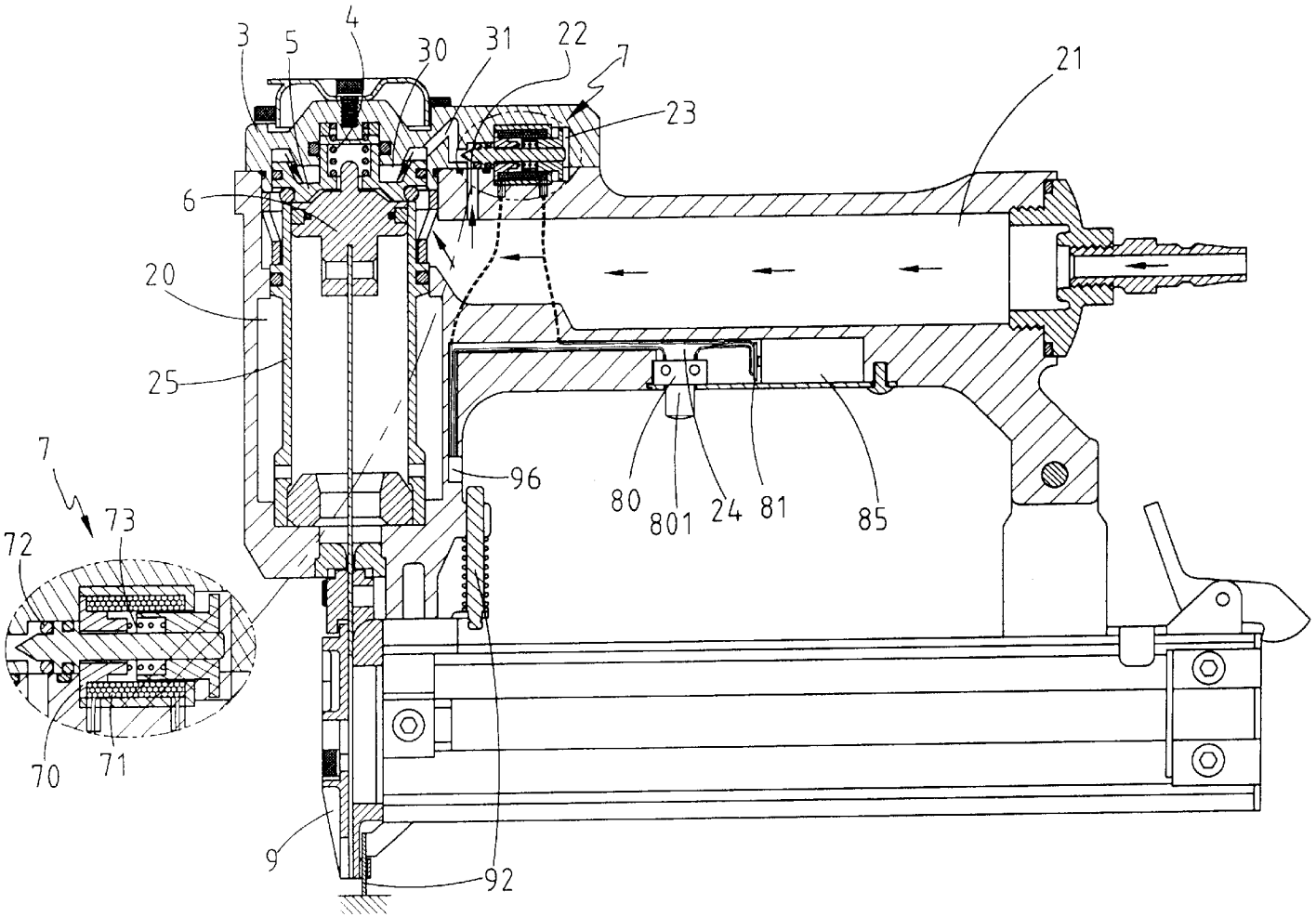
FIG. TWELVE

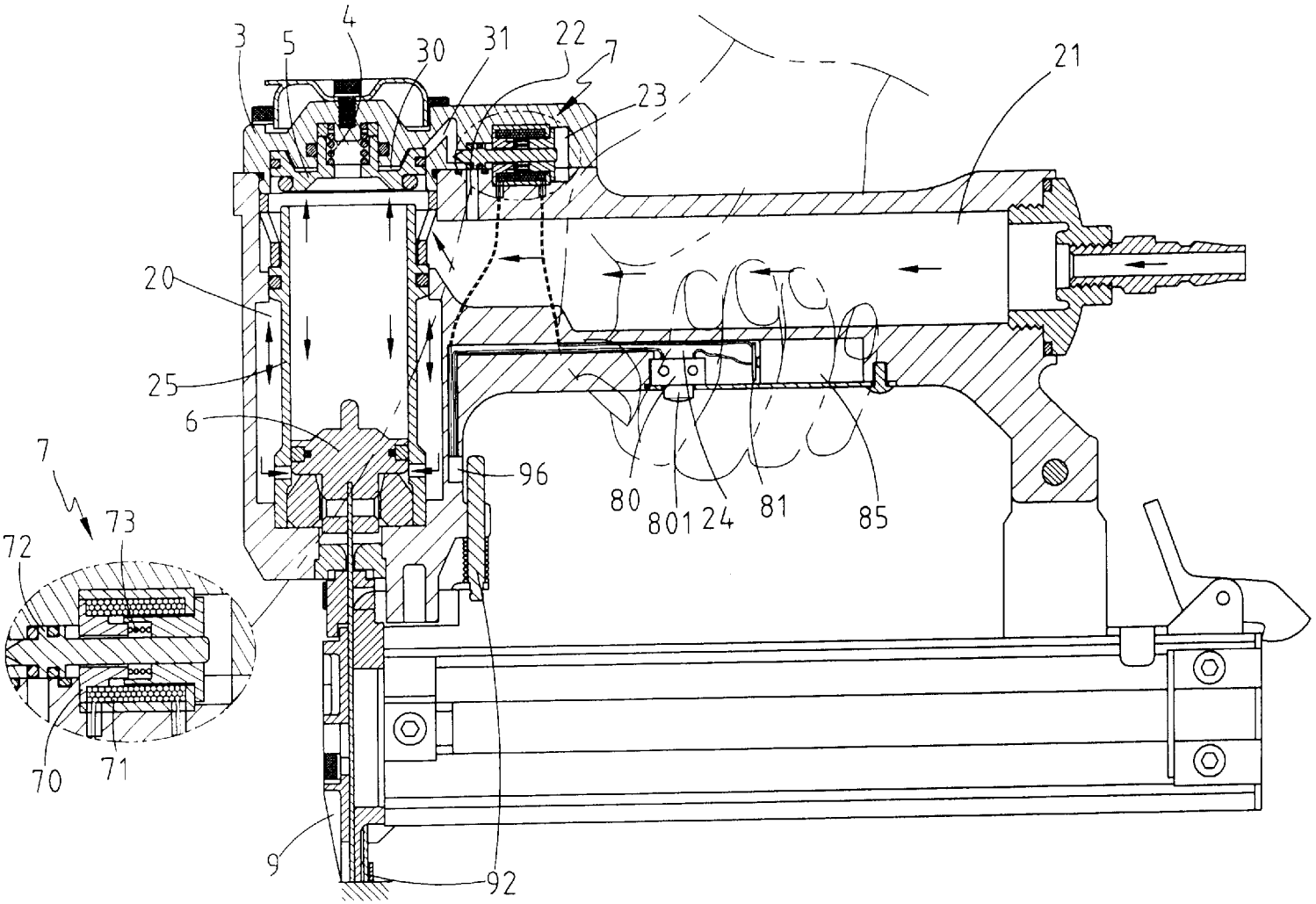
FIG. THIRTEEN

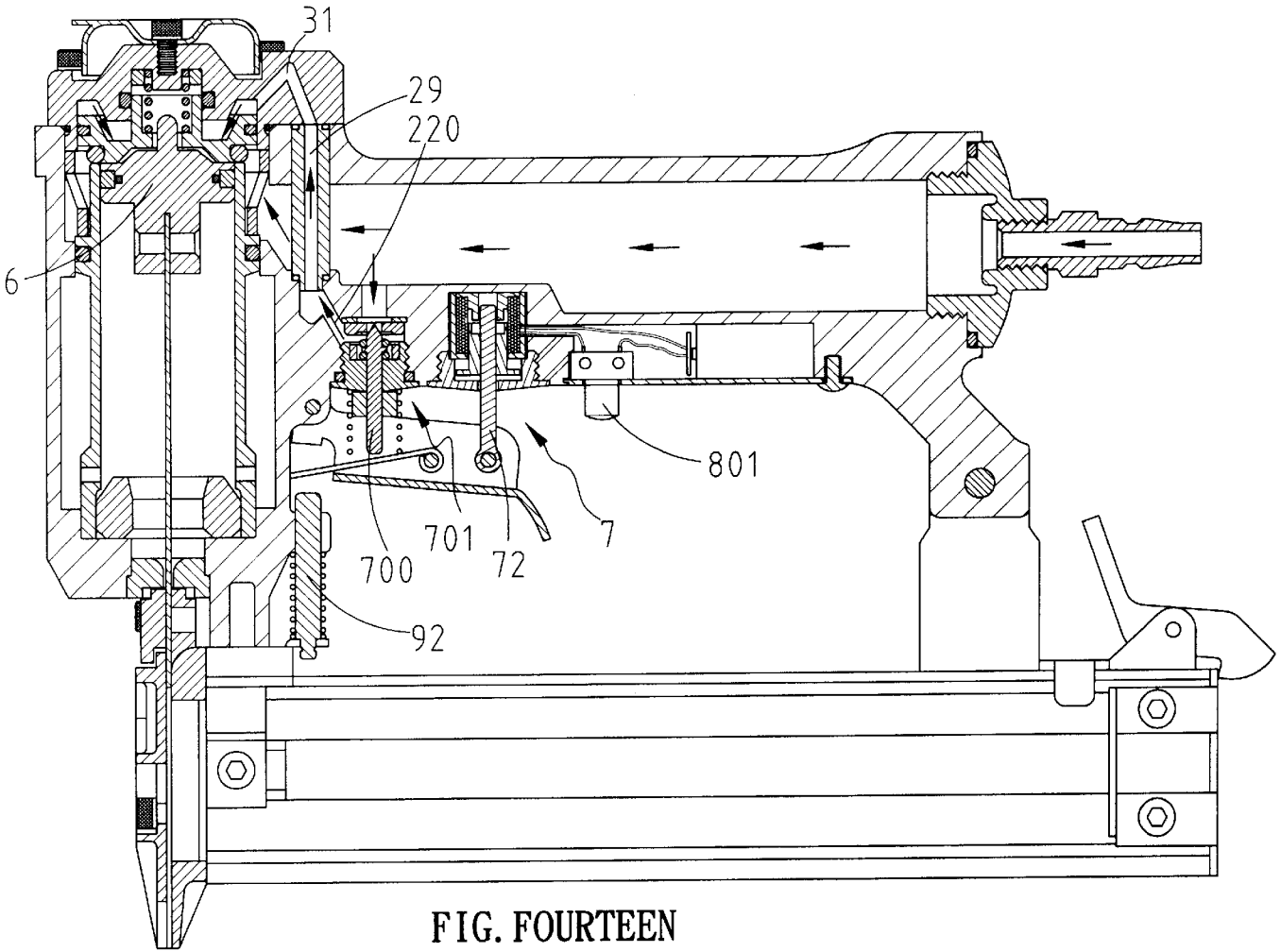
FIG. FOURTEEN

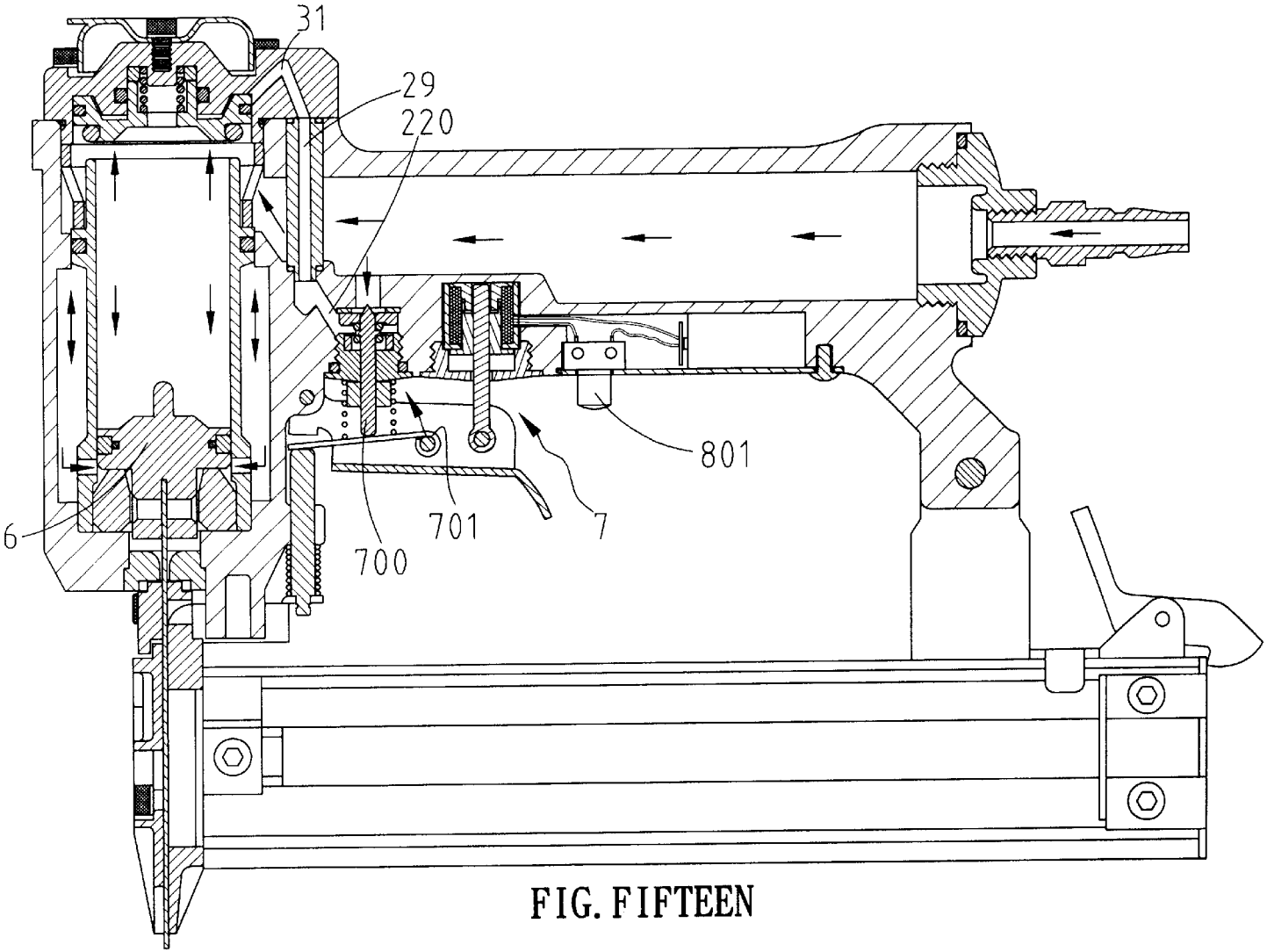
FIG. FIFTEEN

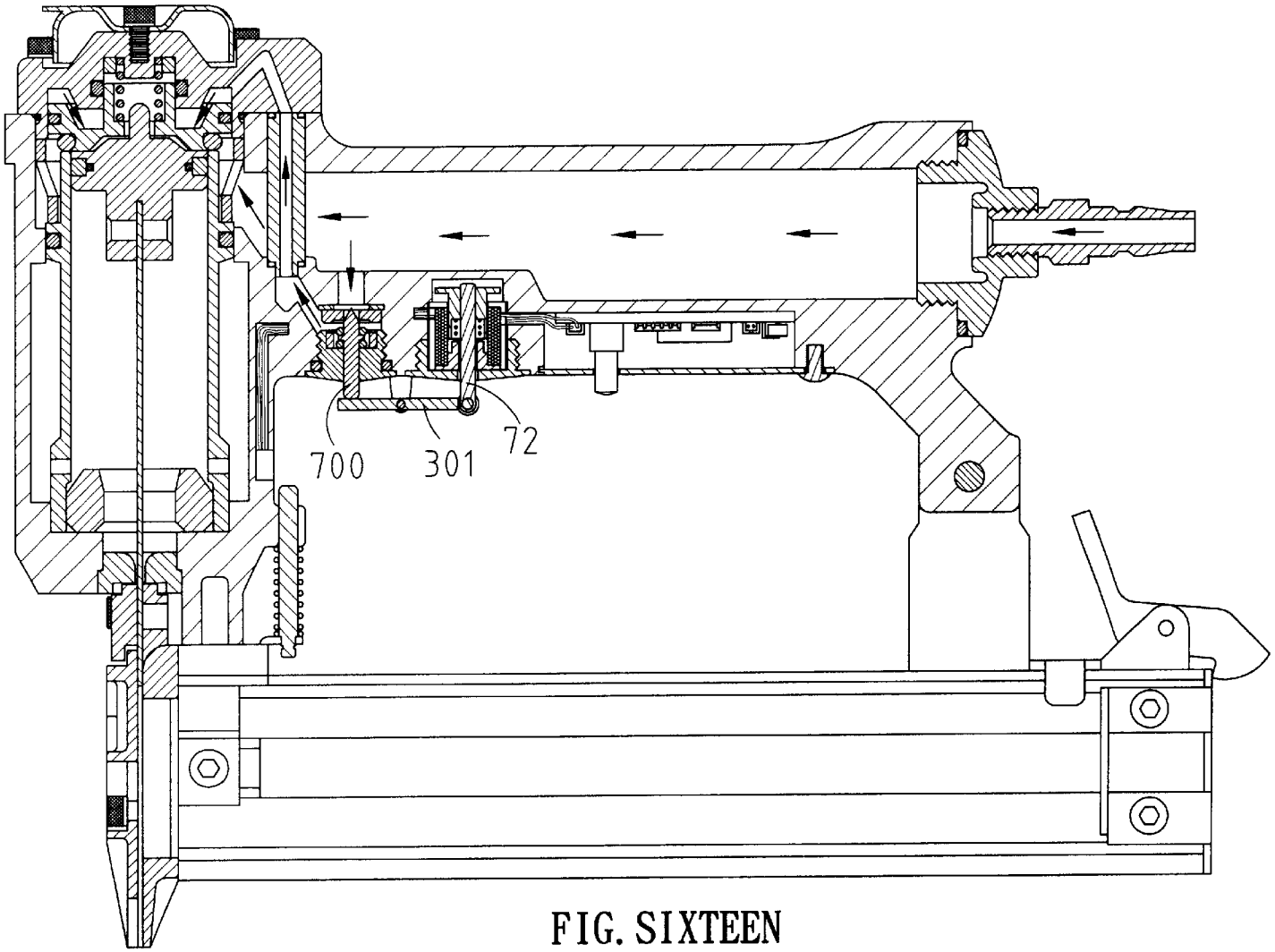
FIG. SIXTEEN

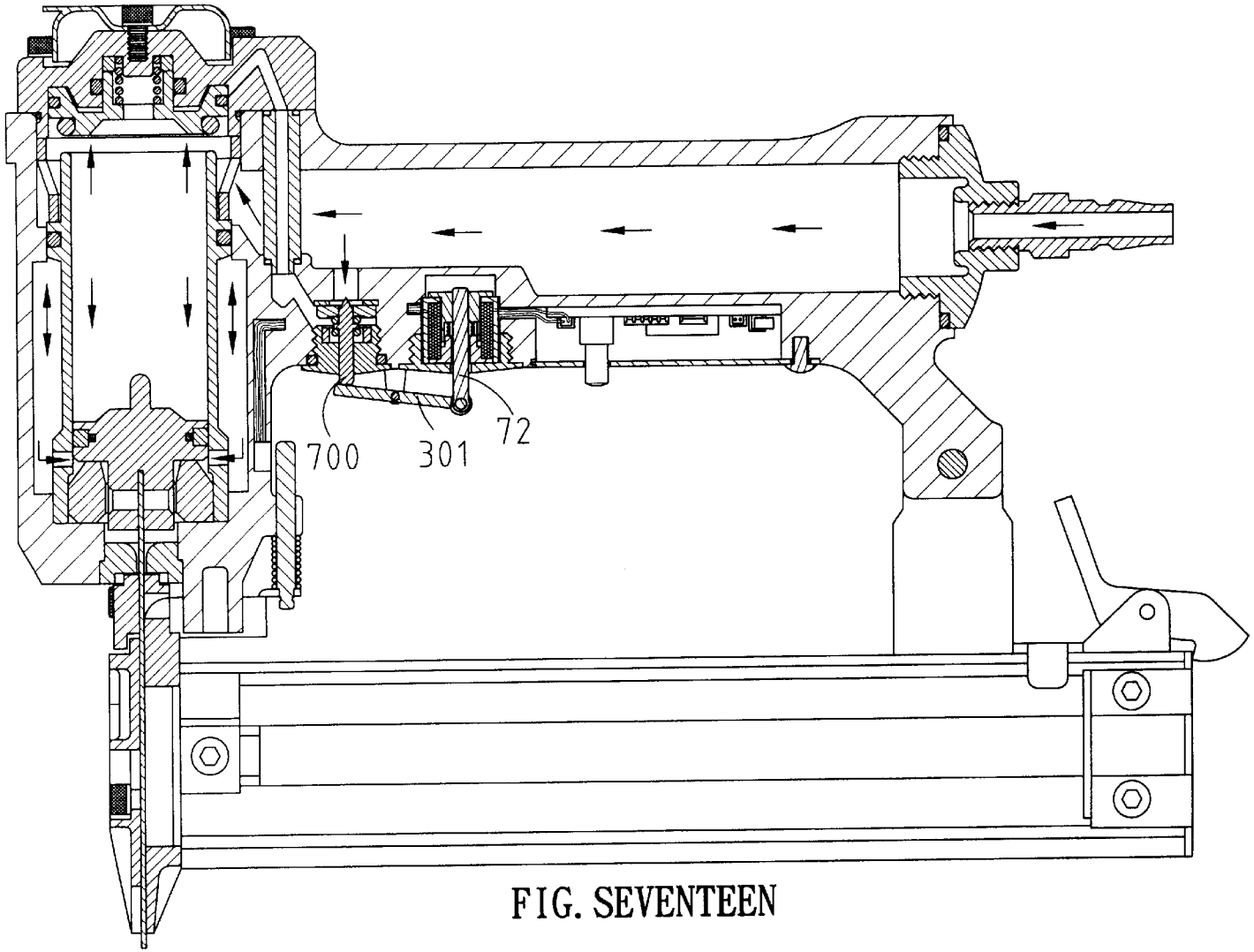
FIG. SEVENTEEN

TRIGGER ASSEMBLY FOR STAPLE GUNS

FIELD OF THE INVENTION

The present invention relates to a staple gun that includes an electro-magnetic valve which activates a shaft to seal an opening communicating with the main passage so as to change the path of the pressurized air to eject the staple.

BACKGROUND OF THE INVENTION

A conventional staple gun is shown in FIG. 1 and generally includes a handle 1' with a main passage 11' which is connected to a source of air from a compressor (not shown) and a barrel is connected to the handle 1' with a chamber 10' defied in the barrel. A cylinder 24 is received in the barrel 10' and an end mount assembly 2' is connected to a rear end of the barrel and a nose is connected to a font end of the barrel. An end cap 22 is movably connected to an inside of the end mount assembly 2' and biased by a spring 22 so as to seal an open end of the cylinder 24 in which a piston 25 is movably received in the cylinder 24. A magazine for receiving staples is connected to the nose. A recess 12' is defined in a wall of the handle 1' and a trigger valve 4 is received in the recess and can be activated by a trigger 5'. Pressurized air may enter the recess 12' via a gap between the valve 4 and the opening in the wall of the handle 1' and enters a tube 3' engaged with a hole 14 defined in an inside of the handle 1 and a path 20'. The pressurized air enters a space between the end cap 22 and the end mount assembly 2' via the path 20' so that the opening of the cylinder 24 is sealed by the end cap 22 by the pressure in the space and the spring 21.

Referring to FIGS. 2 and 3, when a safety plate 55 is pushed toward the trigger 5' and the trigger 5' is squeezed, the shaft of the trigger valve 4 is shifted to seal the opening communicating with the recess 12', and the pressure in the space mentioned above is reduced so that the end cap 22 is pushed toward the end mount assembly 2' by the pressure in the main passage 11'. Once the end cap 22 is moved to open the open end of the cylinder 24, the piston 25 is moved to eject a staple by a plate connected to the piston 25 from the nose. Air in the cylinder 24 is pushed out via orifices defined through the wall of the cylinder 24 into the chamber 10'. Referring to FIG. 4, after shooting, the trigger 5' is released and the air in the chamber 10' enters the cylinder 24 again to push the piston 25 back to its original position. Simultaneously, air in the main passage 11' enters the tube 3' and the path 20' to assist the spring 21 to move the end cap 22 to seat the open end of the cylinder 24 again.

The safety plate 55 and the trigger 5' are exposed and protrude from the barrel of the staple gun so that they could be tangled by other object or activated unintentionally.

The present invention intends to provide a staple gun wherein path of the pressurized air is changed simply by moving a shaft of an electro-magnetic valve and the shooting processes are simplified and convenient for the users especially for continuously shooting.

SUMMARY OF THE INVENTION

In accordance with one aspect of the present invention, there is provided a staple gun which comprises a barrel with a cylinder received in a chamber of the barrel and an end mount assembly is connected to a rear end of the barrel. An end cap movably seals an open end of the cylinder and a spring is biased between the end cap and an inside of the end mount assembly.

A handle is connected to the barrel and a main passage is defined in the handle so as to be connected to a compressor. The main passage communicates with the chamber in the barrel and an opening which is defined through a wall of the handle. A recess is defined in the handle for receiving an electro-magnetic valve therein and communicates with the opening. The electro-magnetic valve has a shaft which is movable to seal the opening when the electro-magnetic valve is activated. A switch is received in the handle and electrically connected to the electro-magnetic valve. A button is connected to the switch and exposed from the outside of the handle.

A tube is transversely received in the main passage. A first path is defined in the handle and communicates with the recess and a second path in the tube. A third path is defined in the end mount assembly and communicates with the second path and a space defined between the end cap and the end mount assembly.

The present invention will become more obvious from the following description when taken in connection with the accompanying drawings which show, for purposes of illustration only, a preferred embodiment in accordance with the present invention.

BRIEF DESCRIPTION OF THE DRAWINGS

FIG. 1 is a cross sectional view to show a conventional staple gun;

FIGS. 2 and 3 show the safety plate is pushed and the trigger is squeezed of the conventional staple gun;

FIG. 4 shows the piston is moved backward after the trigger of the conventional staple gun is released;

FIG. 5 is a cross sectional view to show the staple gun of the present invention;

FIG. 6 shows the button is pressed to activate the electro-magnetic valve and eject a staple;

FIGS. 7 and 8 show a sensor is used to sense a movement of the safety member so as to activate the electro-magnetic valve;

FIGS. 9 and 10 show a limit switch is used to sense a movement of the safety member so as to activate the electro-magnetic valve;

FIG. 11 shows a cover of the recess is removed and the shaft can be pushed manually;

FIGS. 12 and 13 show the position of the recess is located close to the end mount assembly and no tube is transversely engaged with the main passage, and FIGS. 14 and 15 shows another embodiment of a connection of the electro-magnetic valve and the trigger, and FIGS. 16 and 17 shows yet another embodiment of a connection of the electro-magnetic valve and the trigger.

DETAILED DESCRIPTION OF THE PREFERRED EMBODIMENT

Referring to FIG. 5, the staple gun of the present invention comprises a barrel with a chamber 20 defined therein and a cylinder 25 is received in the chamber 20. A piston 6 is movably received in the cylinder 25 and a plate 60 is connected to the piston 6. A nose 9 is connected to a front end of the barrel and the plate 60 extends through the nose 9 with which a magazine for receiving staples is connected. An end mount assembly 3 is connected to a rear end of the barrel and an end cap 5 movably seals an open end of the cylinder 25. A spring 4 is biased between the end cap 5 and an inside of the end mount assembly 3.

A handle is integrally connected to the barrel and a main passage 21 is defined in the handle. A fitting is connected to the handle so as to be connected to a compressor (not shown). The main passage 21 communicates with the chamber 20 in the barrel. An opening 22 is defined through a wall of the handle and communicates with a recess 23 in the handle. An electro-magnetic valve 7 is engaged with the recess 23 and has a shaft 72 which is movable to seal the opening 22. The electro-magnetic valve 7 includes a casing 70 and coils are received in the casing 70. A spring 73 applies a force on the shaft 72 to normally maintain the shaft 72 at a position where the opening 22 is not sealed.

A switch 80 is received in another recess 24 in the handle and electrically connected to the electromagnetic valve 7 by wires. A button 801 is connected to the switch 80 and exposed from the outside of the handle. A power supply such as a battery 85 is connected to a battery base 81 which is received in the handle. The battery 85 provides electric power to the electro-magnetic valve 7.

A tube 290 is transversely received in the main passage 21 and a first path 220 is defined in the handle and communicates with the recess 23 and a second path 29 in the tube 290. A third path 31 is defined in the end mount assembly 3 and communicates with the second path 29 and a space 30 defined between the end cap 5 and the end mount assembly 3.

When pressing the button 801, the electro-magnetic valve 7 is activated and the shaft 72 moves to seal the opening 22 so that the pressurized air cannot enters the opening 22 and the space 30 between the end cap 5 and the end mount assembly 3, so that the pressurized air applies a force which is larger than the spring force from the spring 4 so as to push the end cap 5 away from the cylinder 25. The open end of the cylinder 25 is opened and the piston 6 is moved toward the nose 9 by the pressurized air which enters the cylinder 25 via the open end of the cylinder 25. After the electro-magnetic force is disappeared, the spring 73 draws the shaft 72 backward and the pressurized air can enter the space between the end cap 5 and the end mount assembly 3 so as to push the end cap 5 to seal the open end of the cylinder 25 again.

FIGS. 7 and 8 show that the wire is replaced by a circuit board 95 and a safety member 92 is connected to a distal end of the nose 9. A sensor 96 is connected to the barrel and is activated by a movement of the safety member 92 to activate the electro-magnetic valve 7.

FIGS. 9, the sensor can be replaced by a limit switch 97 which is connected to the barrel and the limit switch 97 is activated by a movement of the safety member 92 to activate the electro-magnetic valve 7.

Referring to FIGS. 10 and 11, a cover 75 is removably engaged with the recess 23 so that when the electromagnetic valve 7 is damaged, the user may remove the cover 75 and the shaft 72 can be pushed by fingers.

Another embodiment is shown in FIGS. 12 and 13, the recess 23 is located beside the end mount assembly 3 and an opening 22 is defined through a wall of the handle and communicates with a recess 23. An electro-magnetic valve 7 is engaged with the recess 23 and has a shaft 72 which is movable to seal the opening 22. A path 31 is defied in the end mount assembly 3 and communicates with the recess 23 and a space 30 defined between the end cap 5 and the end mount assembly 3. Therefore, the outer appearance of the handle can be more linear and only the button 801 is exposed.

FIGS. 14 and 15 show another embodiment wherein the electro-magnetic valve 7 and the trigger valve 701 are indirectly connected to the trigger so that when the safety plate 92 is pushed, the opening is sealed by the shaft 700 of the trigger valve 701 and when the button 801 is pushed, the piston 6 is moved.

FIGS. 16 and 17 show that the shaft 700 and the shaft 72 are pivotably connected to a connection bar 702 which is pivotably connected to the handle at an intermediate point thereof. When the electro-magnetic valve 7 is activated, the shaft 71 is moved away from the handle, and the shaft 700 is pushed to seal the opening and a staple is ejected.

While we have shown and described the, embodiment in accordance with the present invention, it should be clear to those skilled in the art that further embodiments may be made without departing from the scope of the present invention.

What is claimed is:

1. A staple gun comprising:

a barrel with a chamber defined therein and a cylinder received in the chamber, a piston movably received in the cylinder and a plate connected to the piston, a nose connected to a front end of the barrel and the plate extending through the nose, an end mount assembly connected to a rear end of the barrel and an end cap movably sealing an open end of the cylinder, a spring biased between the end cap and an inside of the end mount assembly;

a handle connected to the barrel and a main passage defined in the handle, the main passage communicating with the chamber in the barrel, an opening defined through a wall of the handle and communicating with a recess in the handle, an electro-magnetic valve engaged with the recess and having a shaft which is movable to seal the opening, a switch received in the handle and electrically connected to the electro-magnetic valve, a button connected to the switch and exposed from the outside of the handle, and a tube transversely received in the main passage, a first path defined in the handle and communicating with the recess and a second path in the tube, a third path defined in the end mount assembly and communicating with the second path and a space defined between the end cap and the end mount assembly.

2. The staple gun as claimed in claim 1, wherein a safety member is connected to a distal end of the nose and a sensor is connected to the barrel, the sensor being activated by a movement of the safety member to activate the electro-magnetic valve.

3. The staple gun as claimed in claim 1, wherein a safety member is connected to a distal end of the nose and a limit switch is connected to the barrel, the limit switch being activated by a movement of the safety member to activate the electro-magnetic valve.

4. The staple gun as claimed in claim 1, wherein a cover is removably engaged with the recess.

5. The staple gun as claimed in claim 1, wherein the shaft is biased by a spring.

6. A staple gun comprising:

a barrel with a chamber defined therein and a cylinder received in the chamber, a piston movably received in the cylinder and a plate connected to the piston, a nose connected to a front end of the barrel and the plate extending through the nose, an end mount assembly connected to a rear end of the barrel and an end cap movably scaling an open end of the cylinder, a spring biased between the end cap and an inside of the end mount assembly;

a handle connected to the barrel and a main passage defined in the handle, the main passage communicating with the chamber in the barrel, an opening defined through a wall of the handle and communicating with a recess in the handle, an electro-magnetic valve engaged with the recess and having a shaft which is movable to seal the opening, a switch received in the handle and electrically connected to the electro-magnetic valve, a button connected to the switch and exposed from the outside of the handle, and a path defined in the end mount assembly and communicating with the recess and a space defined between the end cap and the end mount assembly.

7. The staple gun as claimed in claim 6, wherein a safety member is connected to a distal end of the nose and a sensor is connected to the barrel, the sensor being activated by a movement of the safety member to activate the electro-magnetic valve.

8. The staple gun as claimed kin claim 6, wherein a safety member is connected to a distal end of the nose and a limit switch is connected to the barrel, the limit switch being activated by a movement of the safety member to activate the electro-magnetic valve.

9. The staple gun as claimed in claim 6, wherein the shaft is biased by a spring.

10. A staple gun comprising:

a barrel with a chamber defined therein and a cylinder received in the chamber, a piston movably received in the cylinder and a plate connected to the piston, a nose connected to a front end of the barrel and the plate extending through the nose, an end mount assembly connected to a rear end of the barrel and an end cap movably sealing an open end of the cylinder, a spring biased between the end cap and an inside of the end mount assembly;

a handle connected to the barrel and a main passage defined in the handle, the main passage communicating with the chamber in the barrel, an opening defined through a wall of the handle and communicating with a recess with which a trigger valve is engaged, an electro-magnetic valve connected to an outside of the handle and electrically connected to the electro-magnetic valve, the trigger valve including a shaft which movably seals the opening and the electro-magnetic valve having a shaft, the shaft of the trigger valve and the shaft of the electro-magnetic valve respectively and pivotably connected to a connection bar which is pivotably connected to the handle at an intermediate point thereof, when the electro-magnetic valve is activated, the shaft of the electro-magnetic valve is moved away from the handle and the shaft of the trigger valve is pushed to seal the opening;

a tube transversely received in the main passage, a first path communicating with the recess, a second path in the tube, a third path defined in the end mount assembly, and a space defined between the end cap and the end mount assembly, and a safety tube movably mounted to a distal end of the nose and having a first sensor located at an end thereof, a second sensor located at the distal end of the nose and corresponding to the first sensor, the second sensor electrically connected to the electro-magnetic valve so as to activate the electro-magnetic valve.

* * * * *